United States Patent [19]

Moermond, deceased et al.

[11] Patent Number: 4,504,812

[45] Date of Patent: Mar. 12, 1985

[54] SPHERICAL TRANSFORMER APPARATUS

[76] Inventors: Donald I. Moermond, deceased, late of Hill City, Minn.; Dennis L. Moermond, personal representative; Raymond A. Moermond, personal representative, both of P.O. Box 6, Hill City, Minn. 55748

[21] Appl. No.: 501,795

[22] Filed: Jun. 7, 1983

[51] Int. Cl.[3] ..... H01F 15/04

[52] U.S. Cl. ..... 336/84 C; 336/127; 336/130; 336/230

[58] Field of Search ..... 336/84 C, 120, 121, 336/123, 126, 127, 130, 135, 212, 221, 230, 234 336/84 R

[56] References Cited

U.S. PATENT DOCUMENTS 2,201,453 5/1940 Putnam ..... 336/120 X

FOREIGN PATENT DOCUMENTS 1184557 3/1970 United Kingdom ..... 336/234

*Primary Examiner*—A. D. Pellinen
*Assistant Examiner*—Susan Steward

[57] ABSTRACT

An improved transformer (20) and method of transformer construction. Primary and secondary windings (30 and 32) are spirally wound onto a spherically shaped core member (24). The core is preferably of laminated construction and can be of either planar or radial configuration. A flux intensifier shield member (40) defines an inner spherical cavity (Y) sized to cooperatively overlie and substantially enclose the inner core and winding assembly. The shield may comprise a pair of hemispherically shaped members including radially extending leaf-like vanes (46) that enable and enhance cooling of the core assembly as well as providing improved transformer efficiency and protective shielding of the core assembly.

8 Claims, 17 Drawing Figures

FIG. 11
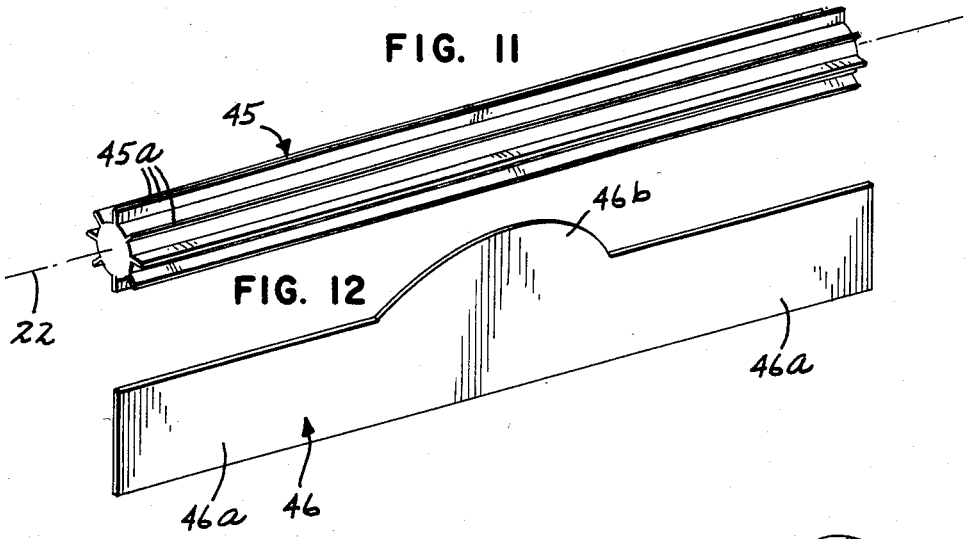
FIG. 12
FIG. 13
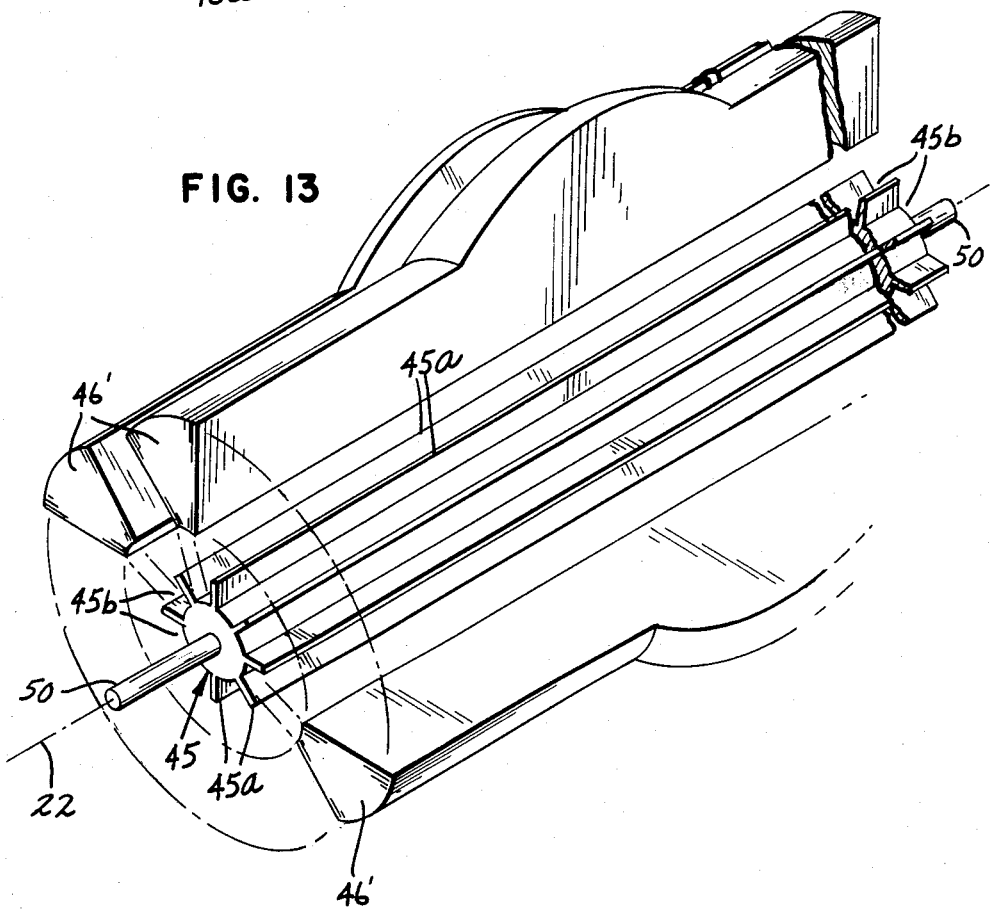

SPHERICAL TRANSFORMER APPARATUS

FIELD OF THE INVENTION

This invention relates generally to electrical power transmission, and more particularly to an improved method of power transmission and transformer construction using spherically shaped magnetic field configurations.

DESCRIPTION OF THE PRIOR ART

The general principals of energy transmission by the use of transformers, have long been known. Such transformers are generally characterized by a primary winding or coil through which an energizing a.c. signal passes, and a secondary winding or coil that is electrically isolated from but arranged in electromagnetic proximity with the primary winding. When the energizing signal passes through the primary winding, it creates an electromagnetic field which induces current flow in the secondary winding. The primary and secondary windings are physically wound about a core material, generally constructed of laminated sheets of iron material. Such power transformers are often labeled according to parameters of the signal induced in the transformer secondary, as compared to like parameters of the excitation signal applied to the primary. For example, a transformer having a higher output voltage appearing across its secondary winding than that voltage applied to its primary winding is referred to as a "step-up" transformer, whereas a transformer having an output voltage less than that of its excitation voltage is referred to as a "step-down" transformer. Sometimes transformers are used merely to electrically isolate the circuit to which the primary windings are connected from that circuit to which the secondary windings are connected. Such transformers are typically referred to as "isolation" transformers.

Transformer construction has generally remained unchanged in the art for a number of years. A typical power transformer of the prior art has a rectangularly shaped laminated core material around which the primary and secondary windings are wound. The core is generally configured in a closed H-frame block shape (illustrated hereinafter in FIG. 7). Besides being difficult to wind, such transformer configuration typically has a relatively low power transmission efficiency. The secondary windings are physically exposed to the external environment making them susceptible to physical damage and to the electrical influence of extraneous electromagnetic fields. In the event of winding failure or shorting, the closed integral construction of the H-frame transformer core has made such transformer difficult and expensive to repair, often necessitating disposal of the entire transformer upon failure. Further, such transformer construction does not generally lend itself well to rotary transformer applications (i.e. wherein the primary and secondary windings are capable of operatively moving relative to one another).

Another problem with prior art transformers relates to their generation and dissipation of heat. Large prior art power transformers, carrying high power levels often use special transformer oils and fluids to help dissipate the heat generated during the transformer operation. Such fluids and oils can be environmentally and physically harmful to humans if they leak out of the transformer.

The present invention directly addresses the abovementioned problems and shortcomings of prior art transformers and applies to all types of power transformers (i.e. step-up, step-down, universal, isolation, and the like). The present invention provides a relatively simple transformer configuration that replaces the H-frame block core with a spherically shaped core upon which the primary and secondary windings are wound, in a manner that enhances the electromagnetic coupling between the primary and secondary windings. Such construction significantly increases the power transmission efficiency of the transformer as compared to those of the prior art. The spherical core construction facilitates winding of the primary and secondary windings on the core, and readily lends itself to rotation of the primary and secondary windings, for rotary electromagnetic transmission applications. The simple construction of this invention also enables ease of repair, including removal and rewinding of primary and secondary windings, and permits ready reuse of the cores of failed transformers. The transformer design of this invention does not require the use of environmentally harmful coolants, but is of a construction that provides improved heat dissipation without the use of liquid coolants.

Unlike the H-frame block type transformer configuration, the transformer windings of the present invention are protected from physical contact and abuse, with a protective shield, thereby increasing the reliability and operative life of the transformer. The outer shield also minimizes the effects of stray magnetic fields on the transformer action, making application of this transformer design particularly attractive for use in micro-processor and microcircuit applications where the reduction of stray magnetic fields is important. The outer shield design of this invention also acts as a good heat sink for cooling the transformer core and windings, lending its construction ideally to those use applications wherein dissipation of heat is important. Transformers constructed according to the principles of this invention are also ideally suited for high-voltage and filament transformer applications as used, for example, in power supplies for low and medium power FM and AM radio transmitters. The principles of this invention are also applicable to the manufacture of "inductive chokes" used to filter out d.c. ripple in rectified a.c. power supplies. The spherical concepts of this invention enable construction of an improved inductive choke having high inductance with low d.c. resistance, providing for larger d.c. signals at the d.c. output terminals of an a.c. rectifier power supply system.

These and other advantages, features, and uses of the invention will become clear upon a more detailed description thereof.

SUMMARY OF THE INVENTION

The present invention provides an environmentally safe, simple and highly efficient transformer design that offers improved reliability, use flexibility, ease of repair and reuse of the core material in the event of winding failure, and improved electromagnetic shielding. The transformer design of the present invention is ideally suited for use with rotary transformer applications wherein the primary and secondary transformer windings can be operatively moved relative to one another. The simplicity of its construction and the improved efficiency thereof provide the user of the transformer principles of this invention to apply such principles to widely varying use applications. This invention is founded upon the use of spherically shaped electromagnetic fields and upon the construction of a transformer configuration which captures and uses the spherically shaped electromagnetic fields to the maximum extent possible, thereby significantly increasing the electromagnetic coupling between the primary and secondary windings of the transformer.

The present invention provides for a transformer core having a spherical shape and for winding the primary and secondary transformer windings about such core so as to maximize electromagnetic coupling therebetween. According to one embodiment of the invention, a pair of pole members extend from opposite sides of a spherical transformer core along a pole axis that passes through the center of the core. A primary winding is spirally wound onto the outer surface of the spherical core and about the pole axis, with the desired number of windings, which extend along the surface of the core material and between the two pole members. In a preferred construction of the invention, a dielectric insulating layer is applied over the primary windings and the secondary transformer windings are spirally wound directly onto the dielectric layer and overlying the primary windings. In a preferred construction of the invention, electrical connection to the primary and secondary windings is provided by extending the terminals of the windings through longitudinally extended passageways formed in the pole members. The secondary windings may also be wound upon or embedded within a spherically shaped shell member overlying but spaced from the primary windings on the core, to provide for relative movement between the primary and secondary windings for rotary transformer applications. A flux intensifier shield is placed to overlie and substantially enclose the core and primary and secondary windings. The flux intensifier shield preferably defines an internal spherical cavity sized slightly larger than the largest diametric measurement of the secondary windings, so as to closely overlie the secondary windings along the entire length of the windings. With such configuration, flux intensifier and coupling paths are provided for substantially all of the electromagnetic waves generated by the primary windings.

The transformer core material is constructed of electrically conductive material, and preferably of iron. More particularly, the core construction is preferably of laminated construction. According to one embodiment of the invention, the core and pole members are integrally formed of laminated sheets of iron material arranged and configured generally parallel to one another. In another embodiment of the invention, the core and pole members are integrally connected and formed by a plurality of iron foil sheets arranged and configured to extend radially outward from the pole axis. In such configuration, the conductive sheets are preferably mounted in cluster groups of such sheets resembling in end view truncated sectors of a circle and are retainably held and mounted to a central hub configured to cooperatively mount and accept such cluster groups of the sheets.

According to a preferred construction of the flux intensifier shield, the shield comprises a pair of hemispherically shaped shell portions configured to cooperatively operatively engage each other to form a protective spherically shaped shield member which overlies in close proximity, the core and primary and secondary windings thereon. A preferred construction of the shield includes a plurality of conductive leaf-like members symmetrically arranged and radially extending outward from a central axis of the shield, which is coaxially aligned with the pole axis of the transformer when the shield is operatively positioned to overlie the core and primary and secondary windings. In a preferred construction of the shield member, the leaf-like members are annulus-shaped metal sheets which extend between first and second ends that are mounted to a pair of cylindrical tube members coaxially aligned with the central axis of the shield. The tube members are sized to concentrically overlie the transformer pole members on opposite sides of the core. A ring-shaped retainer member circumferentially overlies the shield and retainably holds the plurality of leaf-like members at their mid-regions, in spaced radially aligned relationship with one another about the central axis. Such shield configuration, besides providing ample electromagnetic flux intensifier paths for electromagnetic waves generated by the primary transformer windings, shields the primary and secondary windings from external stray electromagnetic fields and provides a finned radiator-like heat exchanger configuration for cooling the enclosed core and primary and secondary windings.

The invention also provides for a method of constructing a transformer using spherical magnetic principles. A preferred method of constructing such a transformer includes:

(a) forming a spherically shaped core member having an access passing centrally therethrough;
(b) forming a pair of pole members extending along the axis and projecting outwardly from the core member on opposite sides thereof;
(c) spirally winding a primary coil in overlying engagement with the core; and
(d) spirally winding a secondary coil overlying the primary coil and electrically insulated therefrom.

The inventive method of constructing the spherical transformer also includes the step of laminating sheets of electrically conductive material together to form the core material. Such lamination can be performed so as to form a core of laminated planar sheets, or to form a core of conductive sheets radially extending outwardly from the pole and core axis. According to the latter core configuration, the method of forming the core member comprises: (a) arranging a plurality of electrically conductive sheets of material in radial alignment about the core axis; and (b) fastening the arranged sheets together with a dielectric material. According to a preferred method of radially arranging the conductive sheets of core material, such sheets are radially aligned and separated by placing them in a magnetic field within a mold, and the step of fastening the aligned sheets together includes introducing epoxy into the mold and between the conductive sheets as they are arranged by the magnetic field. The method of forming a spherical transformer according to the principles of this invention also includes the step of placing a flux intensifier shield in overlying relationship to the core and the pole members such that the core and the primary and the secondary coils are substantially enclosed thereby. To achieve a preferred construction of the flux intensifier shield, such shield is formed by arranging a plurality of conductive leaf-like members in radial alignment about the central pole axis of the transformer.

While the present invention will be described with respect to its application to a stationary transformer configuration wherein the secondary transformer winding is placed directly upon but dielectrically separated from the primary winding, it will be understood that the principles of this invention apply equally well to rotary transformer applications. Further, while the invention will be described in relation to preferred embodiments of the transformer construction, it will be understood that the principles of the invention are not limited to such preferred embodiment constructions. It will be well understood by those skilled in the art that while particular sizes, dimensions, material thicknesses, winding wire dimensions, numbers of windings, and the like will be described in relation to the preferred embodiments disclosed herein, that the invention is not limited to the particulars of such descriptions. Further, while the present invention will be described with respect to its applicability to the use with 50–60 cycle alternating current, that the principles of this invention apply equally well to any a.c. power transmission.

It will also be understood by those skilled in the art that while specific core constructions will be disclosed with respect to the preferred embodiments of this invention, that the invention is not limited to such core construction particulars or to the types of materials used in such construction. In this regard, it will be noted that the relative diametric size relationships between the pole members and the spherical core, as described with respect to the preferred embodiment of the invention, are not presented in a limiting manner, but are merely descriptive of a particular configuration of such pole/-core construction that has found to be particularly effective for use with the particular radial leaf-like core and shield construction used in the preferred embodiment. In similar manner, while a particular flux-intensifier shield configuration will be disclosed with respect to the preferred embodiment of the invention, those skilled in the art will readily perceive yet other configurations and manners for constructing flux intensifier shields according to the principles of this invention. It will be understood that those skilled in the art will readily perceive yet other variations of the invention not specifically described above or in the following specification, but clearly included within the scope of the appended claims.

BRIEF DESCRIPTION OF THE DRAWING

Referring to the Drawing, wherein like numerals represent like parts throughout the several views:

FIG. 11 is a perspective view of a retaining hub member used to construct one embodiment of the core and pole member assembly of FIG. 2;

FIG. 12 is an enlarged perspective view of one vane member used to construct a core and pole member assembly of FIG. 2;

FIG. 13 is an exploded perspective view of a completed core and pole assembly using the retaining hub member of FIG. 11 and a plurality of clusters of vane members of the type illustrated in FIG. 12;

DETAILED DESCRIPTION OF THE INVENTION

Figure 1:
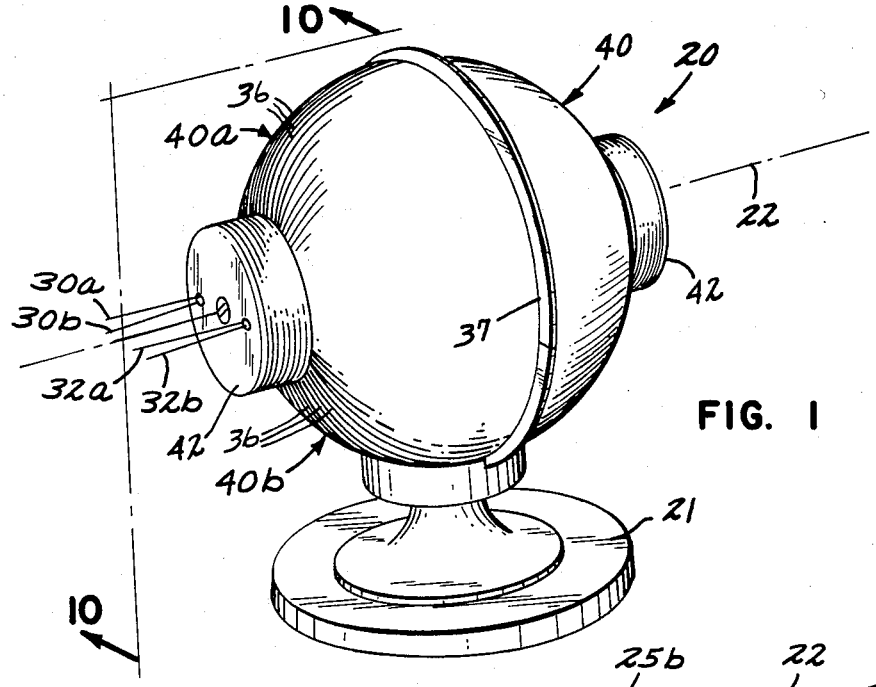
FIG. 1 is a perspective view of a preferred embodiment configuration of a spherical transformer constructed according to the principles of this invention, illustrated as resting upon a mounting pedestal.
Figure 2:
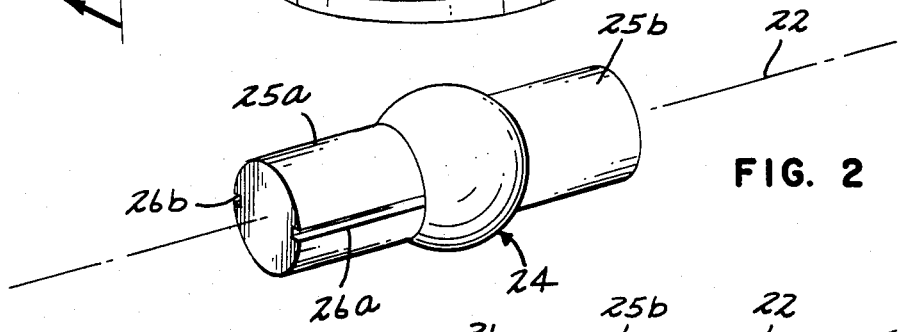
FIG. 2 is a perspective view of a spherical core and attached pole members of the transformer of FIG. 1, constructed according to a preferred embodiment of the invention.

Referring to the Drawings, there is generally illustrated in FIG. 1 a spherical transformer 20 constructed according to the principles of this invention. The transformer 20 as illustrated in FIG. 1 is of a non-rotary (i.e. stationary) construction and is illustrated as mounted upon a pedestal 21. In the preferred construction of the transformer 20 illustrated, the primary and secondary transformer windings are wound about a spherically shaped core member generally designated as 24 in FIG. 2. The core has a pair of pole members **25*a* and 25*b* longitudinally extending outwardly therefrom and on opposite sides of the core 24 about a pole axis 22 that passes through the center of the spherical core 24. In the embodiment illustrated, the pole members are cylindrically shaped and coaxially aligned with the pole axis 22. First and second slots or passageways 26*a* and 26*b* respectively are milled within the outer surface of the pole member 25*a*, forming channels for the primary and secondary winding output terminals (as hereinafter described). The core and pole members may be integrally formed from a single piece of stock material (preferably of electrically conductive material such as iron, or may be independently formed and secured together as illustrated. Two different preferred embodiments of the core/pole member construction will be described in more detail hereinafter. An insulating layer of dielectric material, such as a spray enamel insulation material may be applied to the outer spherical surface of the core 24** prior to application thereof of the primary winding.

Figure 3:
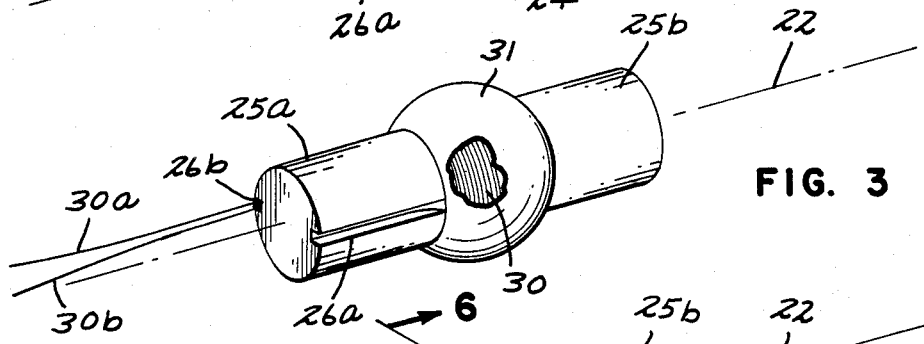
FIG. 3 is a perspective view of the core and pole members of FIG. 2, with a primary coil wound on the core.

Referring to FIG. 3, a primary coil 30 of the transformer is spirally wound about the axis 22, on the outer surface of the core member 24. The size and type of wire comprising the primary winding, as well as the number of layers of such winding that is applied to the core 24 may vary depending upon the particular function to be performed by the transformer. In a preferred construction of the invention, a No. 21 or 22 200° C. DTDO magnet wire has been found to perform satisfactorily for the primary winding. Dielectric insulation material such as epoxy may be applied to the core 24 and to the primary windings themselves to assist in providing electric insulation between the individual windings of the primary coil 30 and to secure the windings against adverse environmental conditions such as vibration. A layer of dielectric insulation is illustrated at 31 in FIG. 3. In the preferred embodiment, the output terminals of 30*a* and 30*b* of the primary winding 30 are positioned within the second slot 26*b* of the pole member 25*a* and provide for connection of the primary winding to an energizing a.c. power source.

Figure 4:
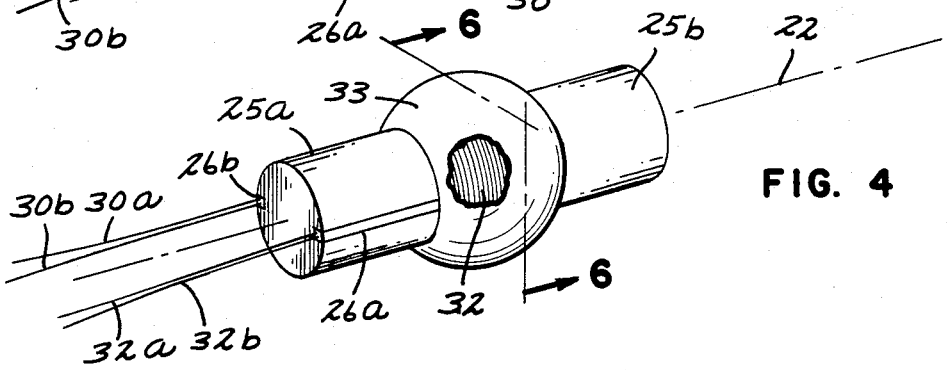
FIG. 4 is a perspective view of the core and pole assembly of FIGS. 2 and 3, with a secondary coil wound thereon.

A secondary coil 32 is spirally wound about the axis 22 and in overlying engagement with the dielectric material 31 on the core 24, as illustrated in FIG. 4. As with the primary winding, dielectric insulating material 33 such as epoxy may be added to the secondary windings 32 to securely bond the secondary windings to the underlying materials. The input and output leads to the secondary winding 32 are mounted within the first slot 26*a* of the pole member 25*a* and provide connection to the output terminals 32*a* and 32*b* of the secondary winding.

Figure 5:
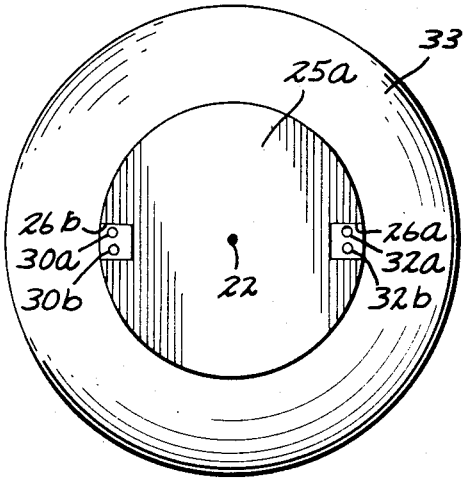
FIG. 5 is an end view of the core, pole member and winding assembly of FIG. 4.
Figure 6:
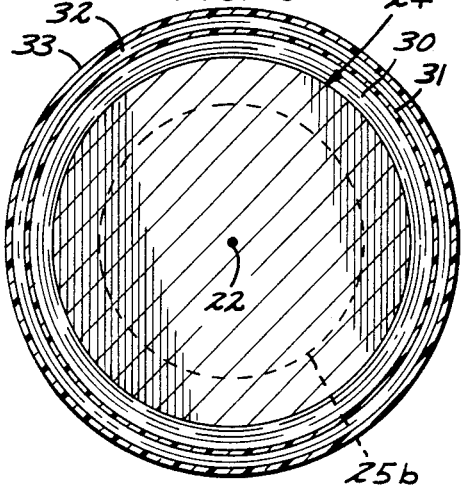
FIG. 6 is a cross-sectional view of the core; pole member and winding assembly of FIG. 4, generally taken along the Line 6—6 of FIG. 4.

FIG. 5 illustrates in more detail an end view of the primary and secondary coil wires passing through the first and second slots 26*a* and 26*b* of the pole member 25*a*. FIG. 6 illustrates the layered relationship of the spherical winding of the primary 30 and secondary 32 windings about the spherical core 24 and the interposed dielectric layers 31 and 33.

Figure 9:
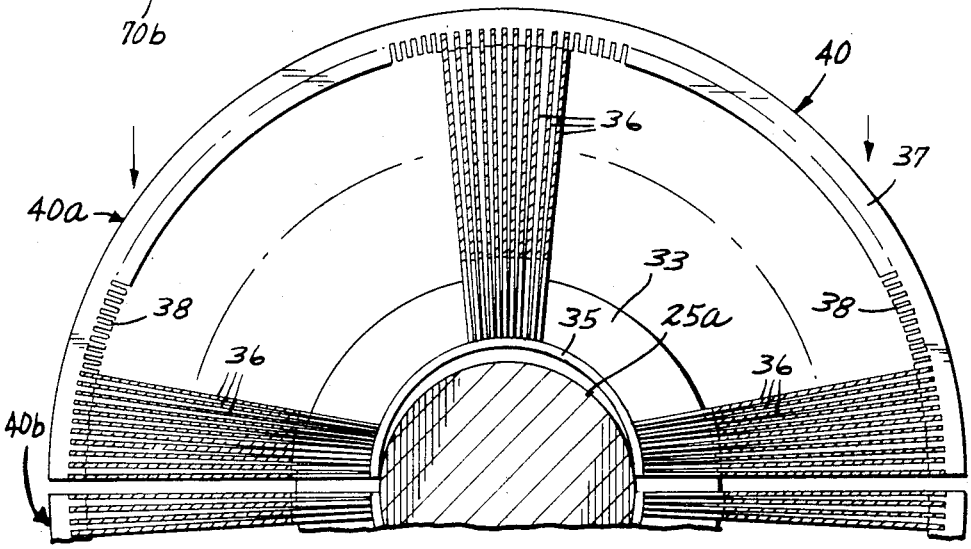
FIG. 9 is a fragmented sectional view illustrating one complete flux-intensifier shield member as it would appear when viewed along the sectional Line 9—9 of FIG. 8 when completed, showing how such shield member would form the upper hemisphere portion overlying the core and primary and secondary windings, but shown slightly raised from its final engagement position with the lower shield hemisphere for illustration purposes.

The round core assembly as illustrated in FIG. 4 is enclosed within a flux intensifier shield assembly, generally designated at 40 in FIG. 1. In the preferred embodiment construction of the shield assembly, the intensifier 40 comprises a pair of separable hemisphere units 40*a* and 40*b* which when cooperatively mated together as illustrated in FIG. 1, define an internal spherical cavity for enclosing the wound core assembly of FIG. 4. A cross-sectional illustration of the two hemisphere portions of the intensifier shield member 40 is illustrated in FIG. 9. Referring thereto, it will be noted that the upper hemisphere portion generally designated at 40*a* is illustrated as slightly "raised" from engagement with the lower hemisphere portion 40*b*. It will be understood that this representation is for illustration purposes only, to show how the two hemisphere portions of the shield would separate from one another, and that in operative use, the upper and lower shield members 40*a* and 40*b* would be tightly engaged with one another as illustrated in FIG. 1. The bifurcated hemisphere-type construction of the flux intensifier shield 40 enables the shield member segments to be easily placed in operative position overlying the wound core assembly, and enables rapid disassembly, providing ready access to the inner core assembly in the event of shorting or failure of the primary or secondary windings. Further, since the intensifier shield assembly can be completely removed from the inner core assembly, thereby completely exposing the inner core assembly, the primary and secondary windings can be readily removed from the underlying core and replaced with new windings, thus enabling virtually unlimited reuse of the core and pole assembly.

Figure 8:
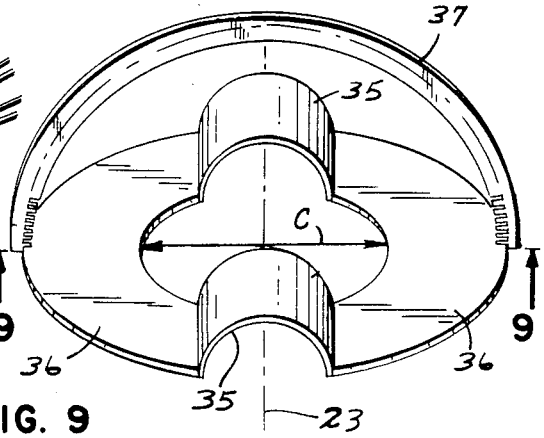
FIG. 8 is a perspective view of a partially assembled portion of one hemisphere of the flux intensifier shield member portion of the transformer illustrated in FIG. 1, illustrating the hemisphere with only two leaf members assembled therein.
Figure 10:
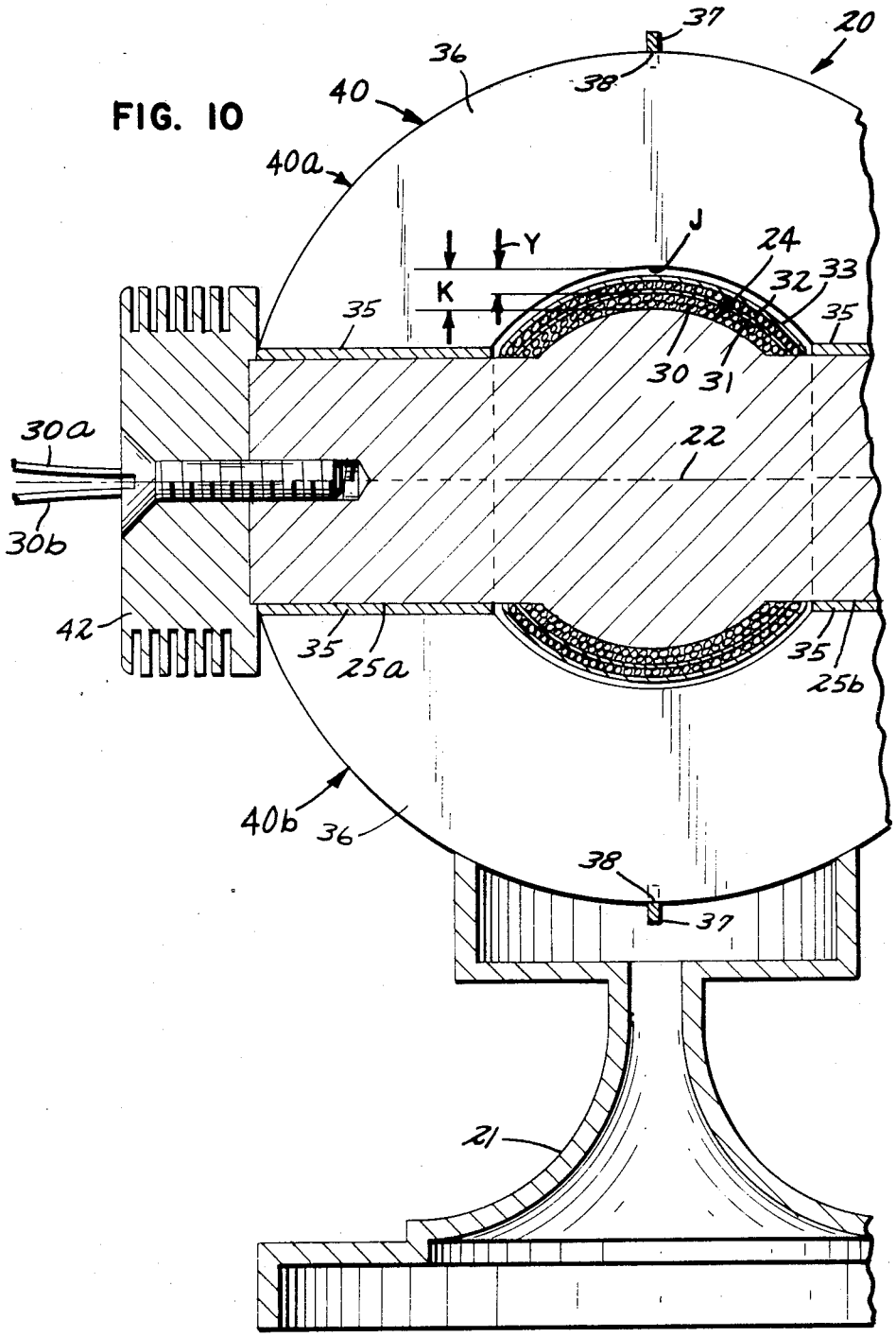
FIG. 10 is a fragmentary sectional view of the spherical transformer of FIG. 1, generally taken along the Line 10—10 of FIG. 1.
Figure 15:
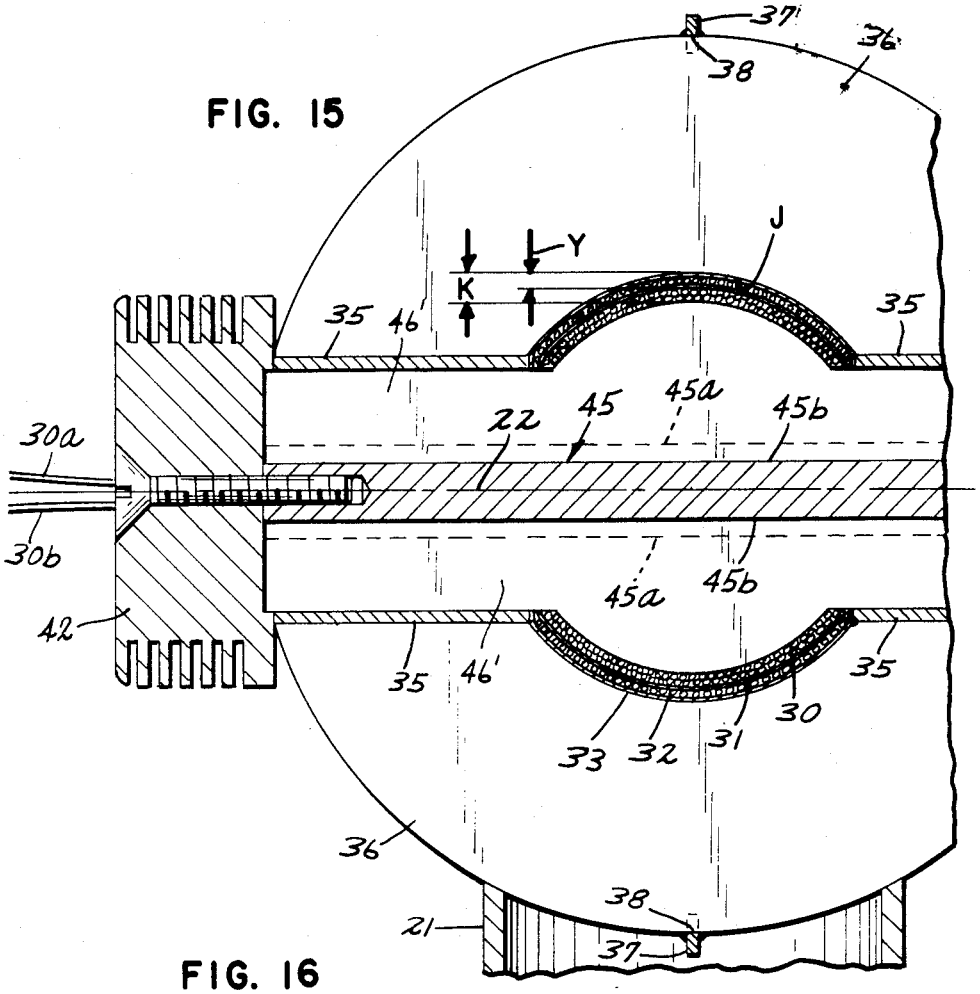
FIG. 15 is a fragmentary cross-sectional view of the spherical transformer of FIG. 1, generally taken along the Line 10—10 of FIG. 1, illustrating an alternate embodiment of the core assembly, as one of the type illustrated in FIG. 13.

A preferred construction of the intensifier shield assembly 40 is illustrated in FIGS. 8, 9 and 15. FIG. 8 illustrates the manner in which one of the flux intensifier hemispheres can be constructed. A pair of cylindrical tube-like support members 35 having an inner radius sized to cooperatively matingly engage the outer surface of the pole members 25 are coaxially aligned and longitudinally spaced from one another so as to engage the pole members 25*a* and 25*b* on oppositely disposed sides of the core 24 (as illustrated in FIGS. 10 or 15). A plurality of annulus-shaped leaf members 36 arcuately extending between first and second ends are arranged such that their ends respectively engage the spaced tube support members 35 (see FIG. 8) and are bonded thereto by epoxy or other appropriate bonding means. Only the first two of such leaf-like members 36 are illustrated in FIG. 8. The leaf-like members 36 are mounted to the outer surfaces of the spaced tube support members 35 such that they are radially aligned with the central axis 23 of the shield assembly. It should be noted that when the shield assembly is operatively mounted in overlying engagement with the pole pieces (as illustrated in FIG. 1), the shield axis 23 is coaxially aligned with and forms a common axis with the pole axis 22. The inner radius of the annulus-shaped leaf-like members 36, as mounted to the tube-like support members 35 is sized relative to the diameter of the core 24 and the thicknesses of the overlying primary and secondary windings and related dielectric materials, such that the inner edges of the leaf-like members 36 closely address but are in slightly spaced relationship to the underlying core assembly when the shield hemispheres are operatively positioned overlying the core assembly. The outer edges of the leaf-like members 36 are retainably secured and held in position by means of a ring-shaped retainer member 37 which circumferentially overlies the leaf-like members 36. The inner surface of the retainer ring 37 is ribbed (generally designated at 38) to retainably hold the outer edges of the leaf-like members 36 in radial alignment with the central axis 23 of the shield assembly. FIG. 9 illustrates in cross-sectional view, the radial alignment configuration of the upper flux-intensifier shield assembly 40*a*. It should be noted that the internal spherical cavity defined by the intensifier shield 40 is illustrated by the "C" dimension in FIG. 8. To avoid any confusion in interpreting the drawings, it should also be noted that the tube support member 35 is illustrated in FIG. 9 as being slightly raised from engagement with the outer surface of the pole membe 25*a* (for illustration purposes only). In operative position, the lower surface of the support member 35 would directly engage the outer surface of the pole members 25*a*, 25*b*. The number of leaf-like members 36 comprising the flux intensifier will depend upon the radius of the tube support members 35, which in turn will depend upon the diameter of the pole pieces 25*a*, 25*b*, and upon the thickness of the individual leaf-like members. In a preferred construction of the invention, the outer diameter of the pole member is approximately 1.81–1.84 inches, and the leaf-like members 36 are constructed from iron sheet material of approximately 0.025 inches. It will be understood by those skilled in the art, that such dimensions can readily be changed to effect the desired design parameters of the transformer. According to a preferred construction of the invention, the thickness of the leaf-like members 36 at their innermost edges is preferably in the range of about 0.01 inches to 0.05 inches.

The hemisphere shield members 40*a* and 40*b* are retainably held in operative position to the underlying core member by means of a pair of retaining cap members 42 secured directly to the pole pieces 25*a*, 25*b* as illustrated in FIGS. 10 and 15. The retaining cap members 42 are peripherally ribbed to provide additional cooling to the inner core assembly, and have holes formed therethrough and aligned with the first and second slots 26*a* and 26*b* of the pole member, to allow the primary and secondary winding terminals to pass therethrough (see FIG. 1).

The core and pole member assembly (FIG. 2) may, as previously described, be of integral or segmented construction. A preferred construction is to form the core and pole members as an integral unit, from laminated layers of iron transformer core material epoxied together. In a preferred construction, the lamination thickness of such a configuration range from approximately 0.029 to 0.032 inches. Such laminated core and pole construction is illustrated in FIGS. 5 and 6. One way of constructing such a unified configuration is to form a laminated block of stock material, from which the spherical core and cylindrical pole members are then turned on a lathe. A cross-sectional view of a transformer using a laminated core of the above-described configuration is illustrated in FIG. 10, wherein the single lamination is illustrated in the cross-sectional view.

Figure 14:
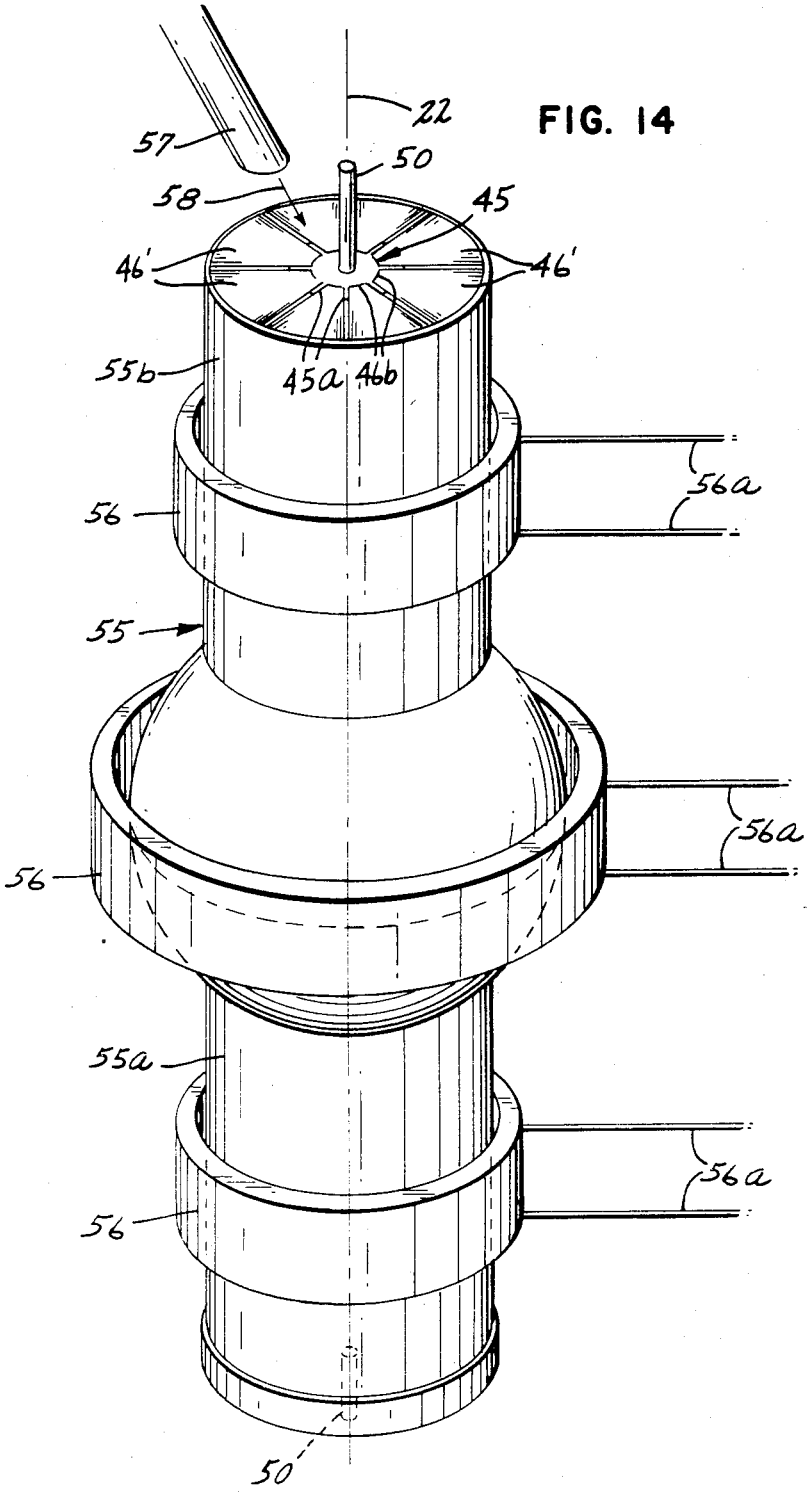
FIG. 14 is a diagrammatic view illustrating a method of constructing a core assembly of the type illustrated in FIG. 13.

An improved method of constructing the core and pole member assembly is illustrated in FIGS. 11 through 15. An aluminum retaining hub 45 has a plurality of dividing vanes 45*a* longitudinally extending and radially projecting outwardly from the outer surface of the hub. In the preferred construction, there are eight such dividing vanes 45*a* milled into the aluminum hub, defining eight slot portions 45*b*. The hub 45 is configured to retainably hold a plurality of conductive sheet vane members 46, one of which is illustrated in FIG. 12. The vane member 46 has rectangularly shaped end portions 46*a* and an arcuately-shaped central portion 46*b*. In the preferred construction, such vane members are constructed of metallic foil material, preferably iron foil material, and have a preferred thickness ranging from approximately 0.0010 inches to 0.0075 inches. In a preferred construction of the invention, the actual thickness of such foil vane is approximately 0.0030 inches. A plurality of the vane members 46 are secured together (by epoxy or other appropriate fastening means) at their lower edges, to form a vane cluster illustrated at 46′ in FIG. 13. One of such vane clusters is fastened and mounted in one of the retaining slots 45*b* of the retaining hub 45, and the process is repeated for each of the slots of the hub 45, until all of the slots 45*b* are filled (see FIG. 13). A pair of pin members 50 are temporarily secured along the central pole axis 22 of the core assembly at opposite ends thereof, and the assembly is placed within a mold 55 as indicated in FIG. 14. A plurality of electromagnets 56 are mounted at appropriate positions along the outer circumference of the mold 55 (mounting not illustrated) and are appropriately energized by means of their respective terminals 56*a* to energizing power sources (not illustrated) for simultaneously energizing the electromagnets, thereby applying an electromagnetic field to the plurality of vane members 46 within the mold 55. The magnetic field applied to the vanes 46 causes the conductive vanes to uniformly radially align and separate themselves within the mold, about the pole axis 22. While the electromagnets are energized, a bonding agent 58 such as epoxy having a very watery consistency, is injected into the mold and between the plurality of vanes 46 by the nozzle 57 until the mold 55 is filled. The magnetic field applied by the electromagnets 56 is maintained until the bonding agent 58 sets. The magnetic field is then removed and the epoxy is allowed to harden, after which the mold is removed. In a preferred embodiment, the mold 55 is of a two-piece construction, having a lower portion 55*a* and an upper portion 55*b*, as illustrated in FIG. 14. A cross-sectional view of the transformer 20 constructed with a core assembly as above-described is illustrated in FIG. 15.

Figure 7:
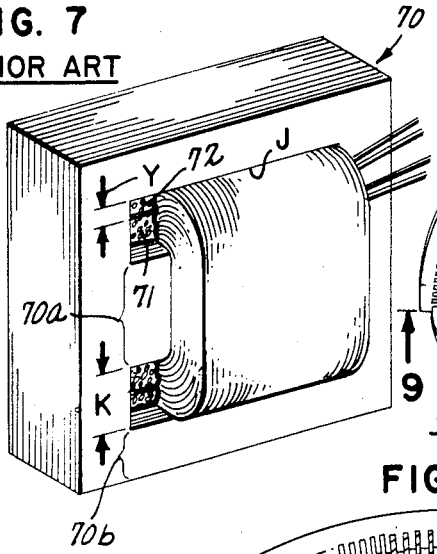
FIG. 7 PRIOR ART
FIG. 7 is a diagrammatic illustration of a prior art transformer construction illustrating a typical H-frame block core configuration.

To facilitate discussion of the present invention in view of the prior art, a typical H-frame block transformer configuration has been illustrated in FIG. 7. Referring thereto, the primary and secondary windings of the transformer are wound about a central H-shaped core structure generally designated at 70. The primary windings are illustrated at 71, and the secondary windings are illustrated at 72. The spacing between the central core region 70*a* and the outer frame portion 70*b* is referred to in the figure as "K". The innermost surfaces of the outer bar portions 70*b* have been labeled with the designation "J". The physical spacing between the outermost winding of the primary coil 71 and the surface "J" is designated at "Y". It is generally known that with such a structure as illustrated in FIG. 7, wherein the secondary windings directly overlie the primary windings, the closer that the last layer of the primary winding is to the surface "J", the greater is the magnetic intensity therebetween. Therefore, it is desirable to minimize the "Y" dimension. It follows that as this magnetic intensity increases, the induced voltage and resultant current in the secondary windings in the "Y" area, also increases, and the greater is the efficiency of the transformer.

These "critical" dimension regions are also found in the spherical transformer of this invention. Referring to FIG. 10, the radial spacing between the upper surface of the core 24 and the inner edge of the annulus-shaped leaf-like member 36 forms the "K" dimension; and the radial distance between the outermost winding of the primary coil 30 and the innermost edge of the leaf-like member 36 defines the "Y"dimension. The significant difference between the spherical core configuration and the H-block core configuration of the prior art is that the "Y" and "K" regions are continuous around the entire circumference of the core upon which windings are wound, as opposed to the "open-end" construction of the prior art H-frame construction. With the present invention, the transformer working area or region "K", becomes a closed spherical cavity which provides for significantly increased electromagnetic induction transfer between the primary and secondary windings of the transformer. In addition, due to the completely encompassing flux intensifier shield construction, which completely encloses the core and windings of the present invention, none of the windings are exposed to extraneous electromagnetic interference from the external environment.

In a first embodiment of the invention, using a planar laminated core configuration as illustrated in FIGS. 5 and 6, the primary coil was wound with four layers of No. 22, 200° C. HAHR magnet wire, providing a primary coil resistance of approximately 4 ohms. Such configuration provided a primary winding thickness of approximately 7/64 of an inch. The spherical cavity dimension "K" was designed for 5/32 of an inch. Accordingly, the outermost winding of the primary coil was within 3/64 of an inch of surface "J". It was found that by applying 120 volts a.c. line current to the primary windings of the above core construction without the use of the flux intensifier shield, the primary coil would draw 8.4 amps, which is 6 to 7 times the normal continuous duty current carrying capacity of the primary wire. Placing the core inside of the flux intensifier shield, the primary current measured approximately 0.175 amperes. Therefore, the primary "power haul-down" for this embodiment was approximately 1008 watts—which creates the electromagnetic intensity within the spherical intensification cavity "Y" of the transformer. A No. 18, 200° C. HAHR wire was selected for the secondary winding, to fill the 3/64 inch spherical cavity "Y", for designing a 28 to 32 volt step-down transformer. The secondary windings were wound directly over the primary windings. The voltage induced in the secondary windings was found to be 32 volts, with little or no voltage drop in the secondary when a full load was applied to the secondary output terminals.

Figure 16:
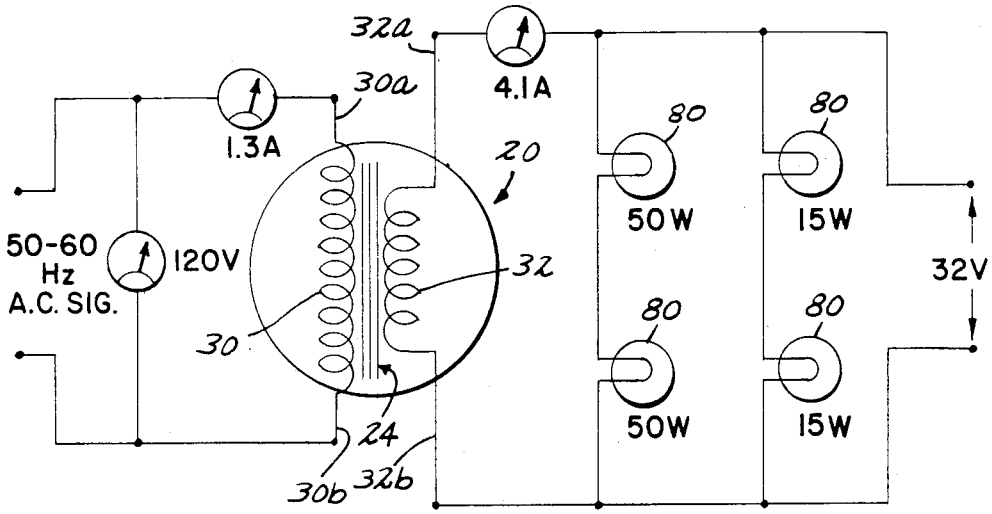
FIGS. 16 and 17 are schematic diagrams of electrical test circuits for measuring test parameters of the spherical transformer of this invention.

The efficiency of the above-described embodiment of a step-down spherical transformer constructed according to the principles of this invention was checked using the below procedure and the simple circuitry of FIG. 16. It is known that the secondary winding No. 18 wire of the type used will carry approximately 4.2 amperes of continuous duty current when wound directly over the primary windings, but when not sealed as is the primary. Maximum power dissipation of the secondary winding is (4.2 amps)×(32 volts)=134 watts. The primary winding has a maximum power dissipation of (1.3 amps)×(120 volts)=156 watts. The secondary output terminals were loaded with four 12 volt a.c. lightbulbs (80 in FIG. 16) until 156 watts was being dissipated in the primary windings (i.e. 1.3 amperes was flowing through the primary windings at 120 applied volts). At this time, 130 watts of power were being dissipated in the load connected to the secondary terminals, providing a transformer efficiency of 130/156 equals 83.3 percent.

Efficiency of the spherical transformer construction can be further improved by use of the core and pole configuration using radially aligned laminations, as previously described with reference to FIGS. 11–15. With such core construction, improved power handling capability of the transformer is achieved due to the fact that the radial laminations in the flux intensifier shield are aligned "edge-to-edge" to the radial laminations of the central core. This results in an improved uniform path for the magnetic flux lines which induce signals within the secondary windings, with significantly less heat generation due to unwanted hysteresis and eddy currents. It was found that the power haul-down of a spherical transformer using the radial lamination core material is significantly increased, thereby greatly increasing the magnetic intensity in the spherical flux intensification cavity "Y".

Figure 17:
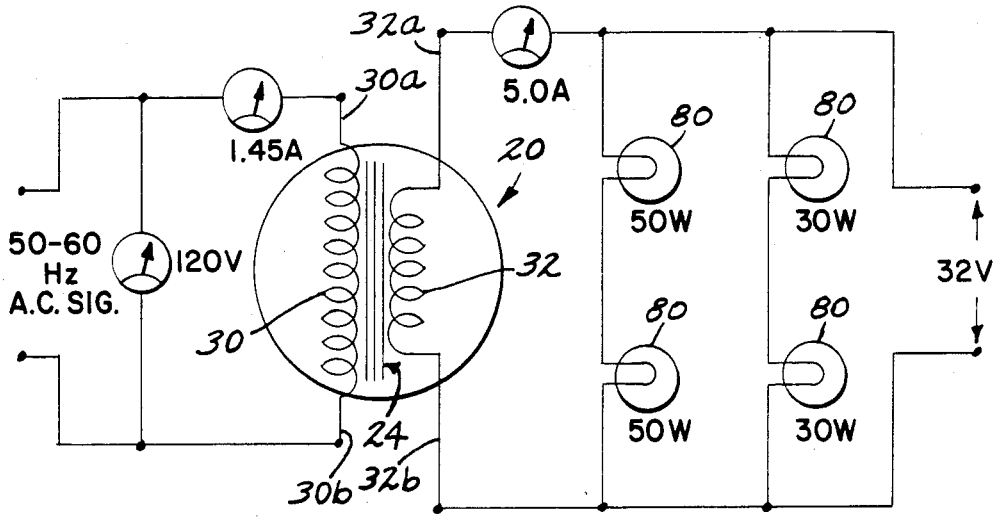

In a preferred construction of a spherical transformer using the radial alignment core, having a pole diameter of 1.81 inches, with the same flux intensifier shield member 40 as previously described, the core was wound with a primary coil of No. 21 wire, with four layers. The heavier wire provided less d.c. resistance and less conductive reactance, providing approximately 10.4 amperes through the windings when measured outside of the flux intensifier shield. Current measured through the primary winding when placed within the flux intensifier shield was approximately 0.150 amps, substantiating the fact that the current haul-down of this configuration was more complete, and providing approximately 1248 watts of magnetic intensity for the "Y" region. The secondary winding was also increased in size to No. 17 wire. Power efficiency measurements with this spherical transformer configuration using the test circuitry of FIG. 17 and similar power considerations to those previously discussed with respect to FIG. 16, revealed an efficiency of 92%. Accordingly, proper design of spherical transformers according to the principles of this invention can be expected to yield transformer efficiencies of 90%.

It can readily be appreciated from the foregoing description, that alternating current power transformers utilizing the spherical concepts of this invention can be readily manufactured for handling virtually any type of power requirements. Further, the concepts of this invention are applicable to all types of power transformers (i.e. step-up, step-down, universal, isolation, and the like), all of which should achieve similar efficiencies as herein described, if properly designed and carefully constructed.

Other modifications of the invention will become apparent to those skilled in the art in light of the foregoing description. This description is intended to provide specific examples of individual embodiments which clearly distinguish and illustrate the present invention. Accordingly, the invention is not limited to the described embodiments, or to the use of specific elements, materials, or configurations described herein. All alternative modifications and variations of the present invention which fall within the broad scope of the appended claims are covered.

It is claimed:

1. A transformer comprising: (a) a spherically shaped core having a pole axis passing through the center thereof; (b) a pair of pole members extending along said pole axis forming opposite sides of said core; (c) a primary winding extending between a pair of primary terminals and spirally wound about said axis, on said core, and (d) a secondary winding extending between a pair of secondary terminals and spirally wound about said pole axis and overlying said primary winding; wherein electrical excitation of said primary winding through said pair of primary terminals electromagnetically induces a responsive signal in said secondary winding; (e) a flux intensifier shield defining an internal spherical cavity and configured to overlie and substantially enclose said core and said primary and secondary windings; (f) said shield comprises a pair of hemispherically shaped portions configured to cooperatively operatively engage each other to form a protective spherically shaped shield member overlying said core and said primary and secondary windings; (g) said shield further comprises a plurality of electrically conductive leaf-like members symmetrically arranged and radially extending outward from a central axis; wherein said central axis and said pole axis are coaxial with one another when said shield is operatively positioned to overlie said core and said primary and said secondary windings.

2. A transformer as recited in claim 1, further including a ring-shaped, internally ribbed retainer member circumferentially overlying said shield and retainably holding said leaf-like members in spaced radially aligned relationship with one another about said central axis.

3. A transformer as recited in claim 1, wherein said core includes a plurality of electrically conductive sheets of material arranged and configured to extend radially outward from said pole axis, wherein the outermost edges of said core sheet materials cooperatively address the innermost edges of said shield leaf-like members.

4. A transformer as recited in claim 1, wherein the thickness of said shield leaf-like members, at their innermost edges is less than 0.1 inches.

5. A transformer as recited in claim 4, wherein the thickness of said shield leaf-like members at their innermost edges is in the range of about 0.01 inches to 0.05 inches.

6. A transformer as recited in claim 1, wherein said shield further includes a pair of cylindrical tube members sized and disposed to concentrically overlie said pole members on opposite sides of said core; wherein said leaf-like members are annulus-shaped, arcuately extending between first and second ends; and wherein said first and second ends of said leaf members are respectively mounted to said pair of tube members.

7. A transformer as recited in claim 6, wherein said tube members are longitudinally bifurcated for enabling said tube members to be operatively fastened to and removed from overlying engagement with said pole members.

8. A transformer as recited in claim 7, further including means for fastening said bifurcated tube members together in overlying engagement with said pole members; whereby the attached leaf-like members of said shield collectively enclose said core and said primary and said secondary windings.

* * * * *